US011064765B2

(12) United States Patent
Lo

(10) Patent No.: US 11,064,765 B2
(45) Date of Patent: Jul. 20, 2021

(54) AIR PAD ASSEMBLY FOR SHOES

(71) Applicant: Chih-Fang Lo, Taichung (TW)

(72) Inventor: Chih-Fang Lo, Taichung (TW)

( * ) Notice: Subject to any disclaimer, the term of this patent is extended or adjusted under 35 U.S.C. 154(b) by 170 days.

(21) Appl. No.: 16/445,214

(22) Filed: Jun. 19, 2019

(65) Prior Publication Data

US 2020/0397094 A1 Dec. 24, 2020

(51) Int. Cl.
*A43B 13/20* (2006.01)

(52) U.S. Cl.
CPC ..... *A43B 13/203* (2013.01); *A43B 13/206* (2013.01)

(58) Field of Classification Search
CPC ..... A43B 13/20; A43B 13/203; A43B 13/206
USPC ..... 36/29
See application file for complete search history.

(56) References Cited

U.S. PATENT DOCUMENTS 4,446,634 A * 5/1984 Johnson ..... A43B 13/206 36/28
4,995,173 A * 2/1991 Spier ..... A43B 5/0407 36/114
4,999,932 A * 3/1991 Grim ..... A43B 7/081 36/114
6,014,823 A * 1/2000 Lakic ..... A41D 19/01523 36/11.5
2006/0032089 A1* 2/2006 Lo ..... A43B 13/206 36/29
2017/0295885 A1* 10/2017 Stern ..... F16F 15/023

* cited by examiner

*Primary Examiner* — Ted Kavanaugh

(57) ABSTRACT

An air pad assembly for shoes includes a rear air pad and a front air pad which communicates with the rear air pad. The front air pad includes a release valve and an inlet. A first tube is connected between the inlet of the front air pad and a first one-way valve of the rear air pad. When the rear air pad is compressed, air in the rear air pad flows into the front air pad. The air in the front air pad releases from the release valve gradually so as to prevent the front air pad from being overly inflated to compress the wearer's foot between the front end of the vamp and the front air pad.

6 Claims, 13 Drawing Sheets

AIR PAD ASSEMBLY FOR SHOES

BACKGROUND OF THE INVENTION

1. Fields of the Invention

The present invention relates to an air pad assembly for shoes, and more particularly, to an air pad assembly that adjusts the pressure between the front air pad and the rear air pad of a shoe according to each operational status.

2. Descriptions of Related Art

The conventional shoes, especially for sport shoes, focus on the buffering feature so as to release pressure and impact transferred to the wearers. Most of the conventional shoes includes an outsole that is made by foam material which is able to be deformed in a certain level to absorb impact from the ground. However, the conventional outsoles have a short life period and are not have to absorb the impact as expected.

An air pad assembly known to applicant discloses a pad and an inflation device which is connected to the pad. When the wearer's heel applies a pressure to the inflation device, the inflation device inflates the air pad to release the pressure to the front end of the wear's foot. When the wearer's heel lifts from the inflation device, the inflation device sucks exterior air and is inflated to release the pressure to both of the front end and the rear end of the wear's foot. However, the inflation device keeps on supplying air to the air pad when it is repeatedly pressed, and the exceeded air in the pad will inflate the air pad too much such that the front end of the wearer's foot is squeezed between the front end of the vamp and the air pad. The air pad may be broken if the air is overly introduced in to the air pad.

The present invention intends to provide an air pad assembly for shoes to eliminate the shortcomings mentioned above.

SUMMARY OF THE INVENTION

The present invention relates to an air pad assembly for shoes, and comprises a rear air pad having a resilient member received therein. A first one-way valve and a second one-way valve are respectively connected to the rear air pad. The rear air pad sucks exterior air from the second one-way valve. A front air pad has a release valve and an inlet. A first tube is connected between the inlet of the front air pad and the first one-way valve of the rear air pad. When the rear air pad is compressed, air in the rear air pad flows into the front air pad via the connected the first one-way valve, the first tube and the inlet. The air in the front air pad releases gradually from the release valve. The maximum air volume released from the release valve is smaller than the maximum air volume entering into the inlet of the front air pad.

The air pad assembly also provides a buffering feature when the wearer jumps and touches the ground by the gradually releasing air from the front pad.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
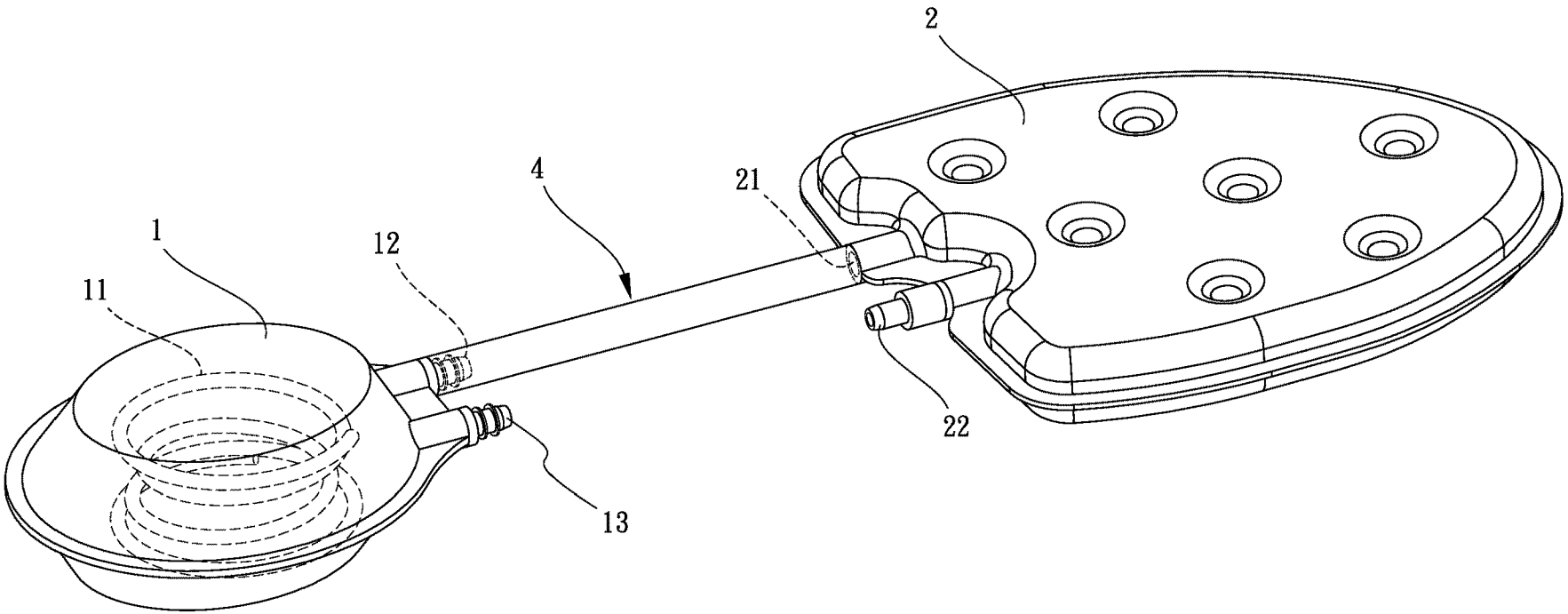
FIG. 1 is a perspective view to show the air pad assembly of the present invention.
Figure 2:
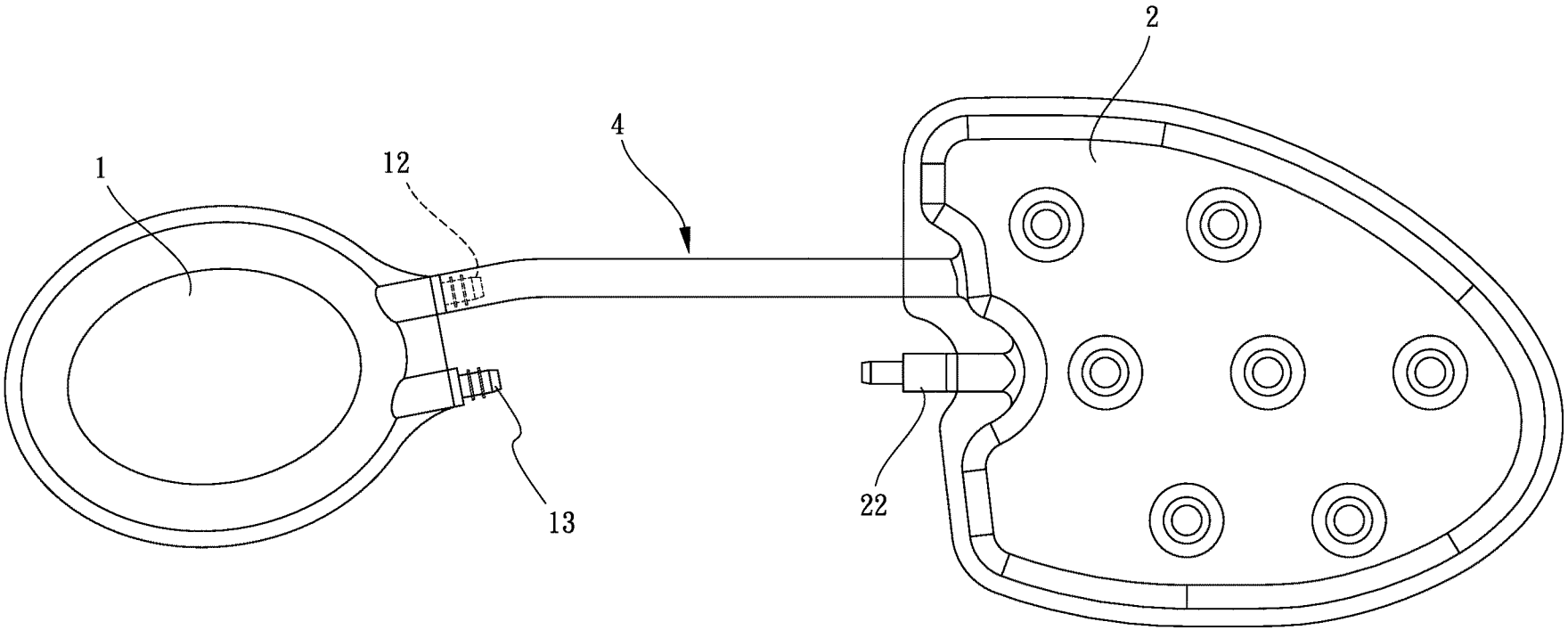
FIG. 2 shows the bottom view of the air pad assembly of the present invention.

Referring to FIGS. 1 and 2, the air pad assembly of the present invention comprises a rear air pad 1 having a resilient member 11 received therein. A first one-way valve 12 and a second one-way valve 13 are respectively connected to the rear air pad 1. The rear air pad 1 sucks exterior air from the second one-way valve 13. A front air pad 2 has a release valve 22 and an inlet 21. A first tube 4 is connected between the inlet 21 of the front air pad 2 and the first one-way valve 12 of the rear air pad 1.

When the rear air pad 1 is compressed, air in the rear air pad 1 flows into the front air pad 2 via the connected the first one-way valve 12, the first tube 4 and the inlet 21. The air in the front air pad 2 releases from the release valve 22 gradually. It is noted that the maximum air volume released from the release valve 22 is smaller than the maximum air volume entering into the inlet 21 of the front air pad 2. Therefore, the front air pad is not overly inflated to compress the wearer's foot between the front end of the vamp and the front air pad.

As shown in FIGS. 3 to 7, the air pad assembly of the present invention is installed in the outsole 100 or insole. As described, when the rear air pad 1 is compressed, air in the rear air pad 1 flows into the front air pad 2, and the air in the front air pad 2 is gradually releases from the release valve 22, so that when the front portion of the wearer's foot steps downward, the front air pad 2 provides buffering feature to the foot.

Figure 4:
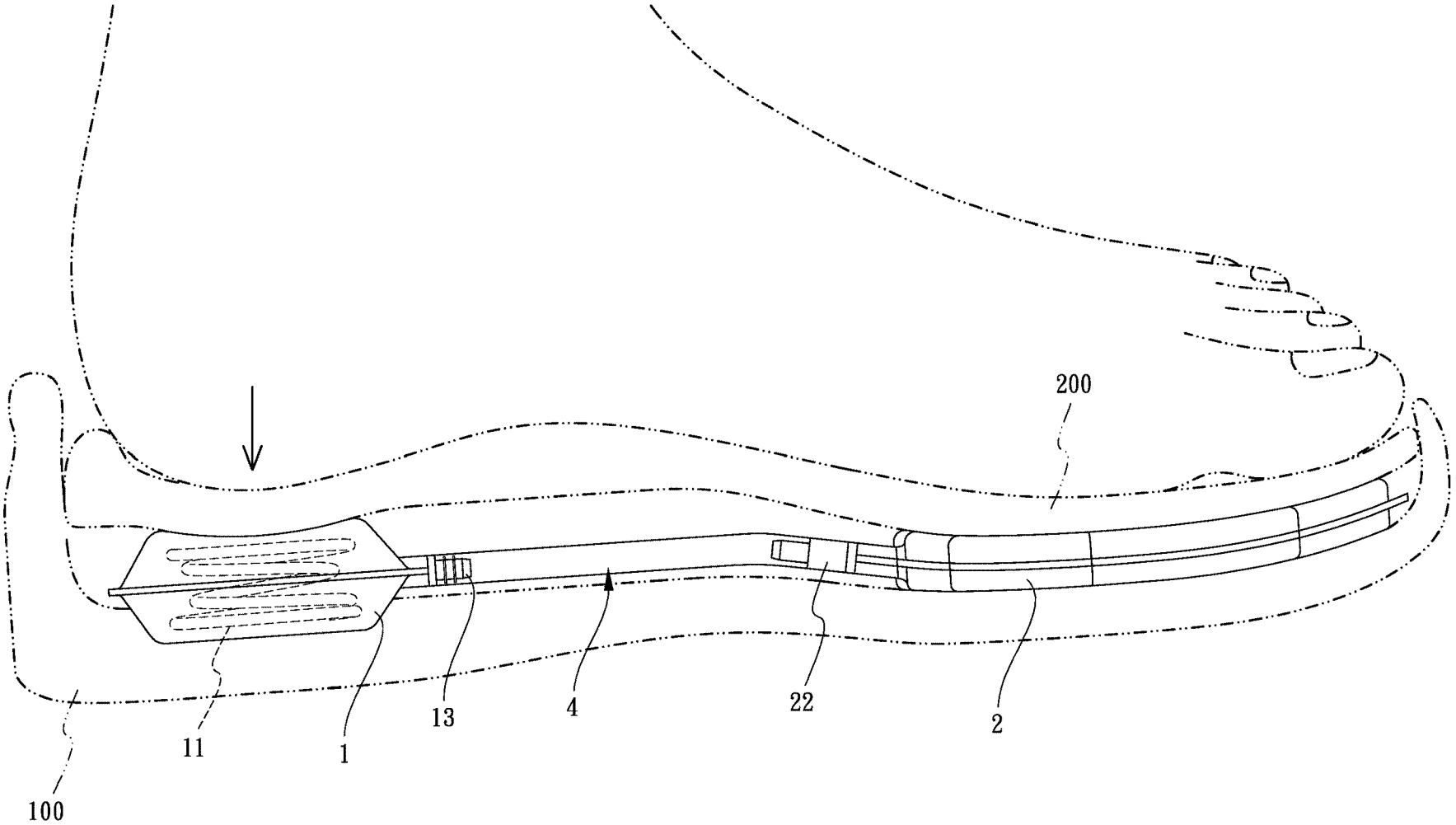
FIG. 4 shows that when the rear air pad of the air pad assembly of the present invention is compressed.
Figure 5:
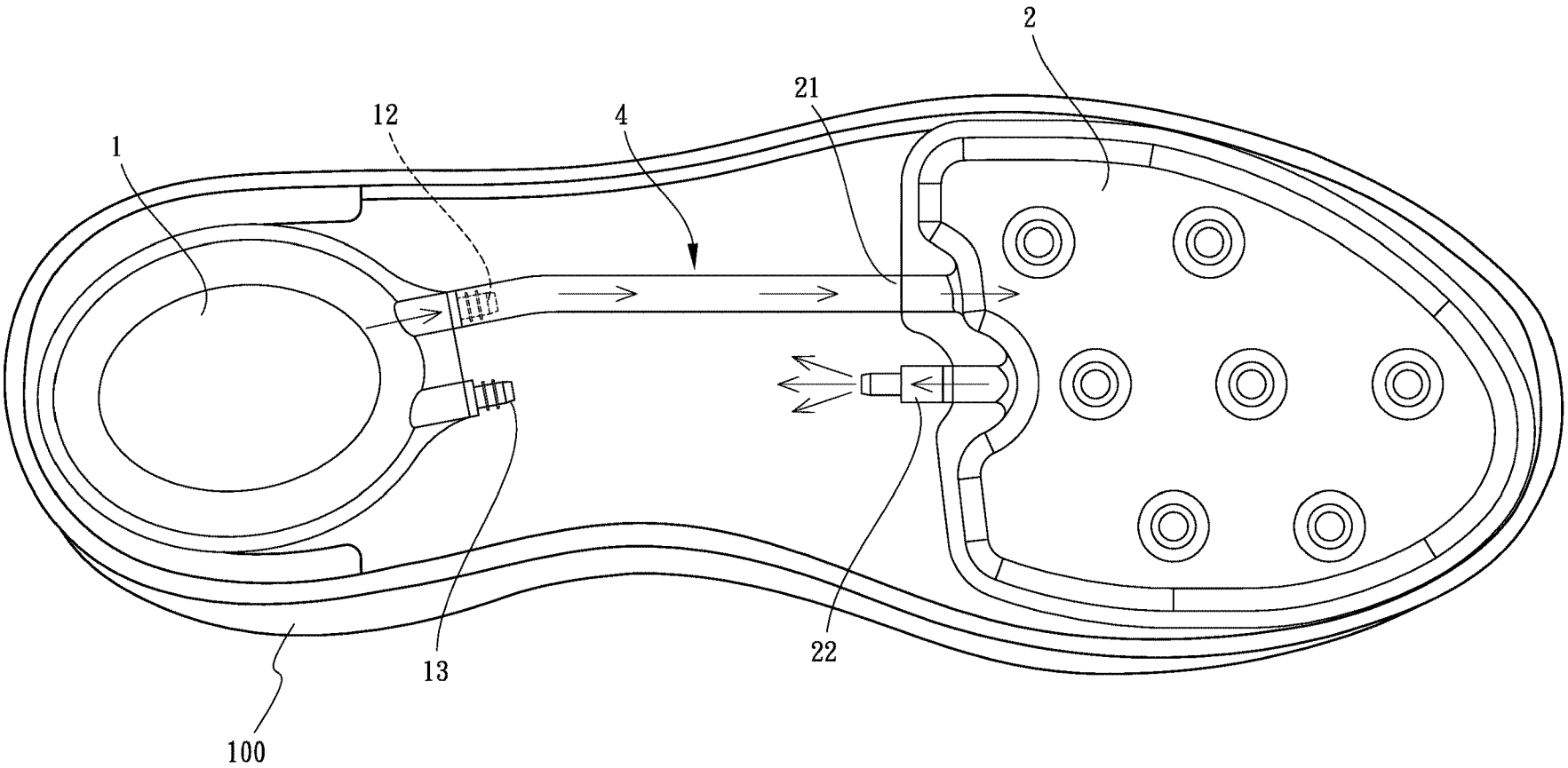
FIG. 5 shows the flow of the air when the rear air pad of the air pad assembly of the present invention is compressed.
Figure 6:
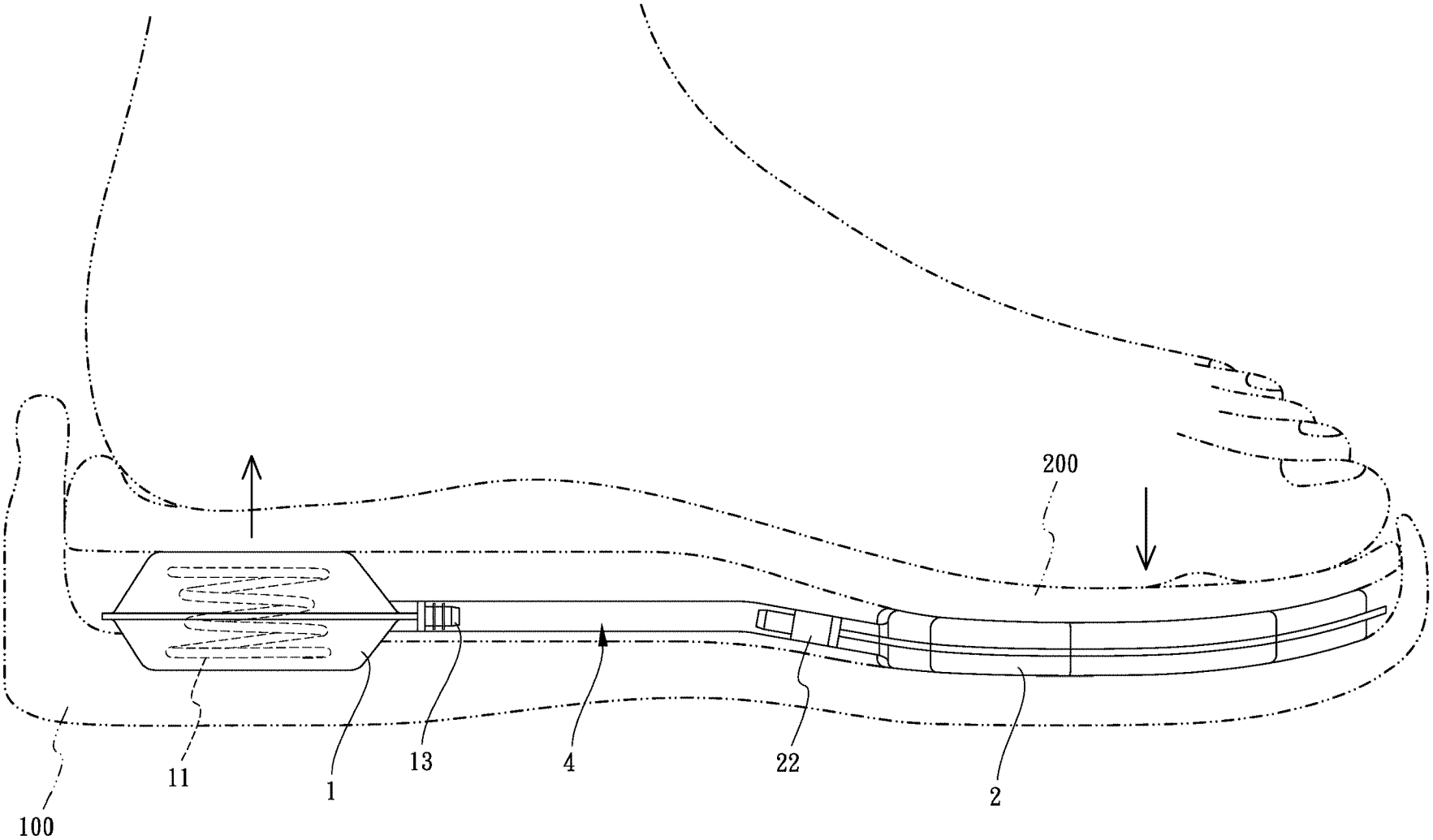
FIG. 6 shows the air pad assembly of the present invention when the wearer's heel lifts and the front portion of the wearer's steps downward.
Figure 7:
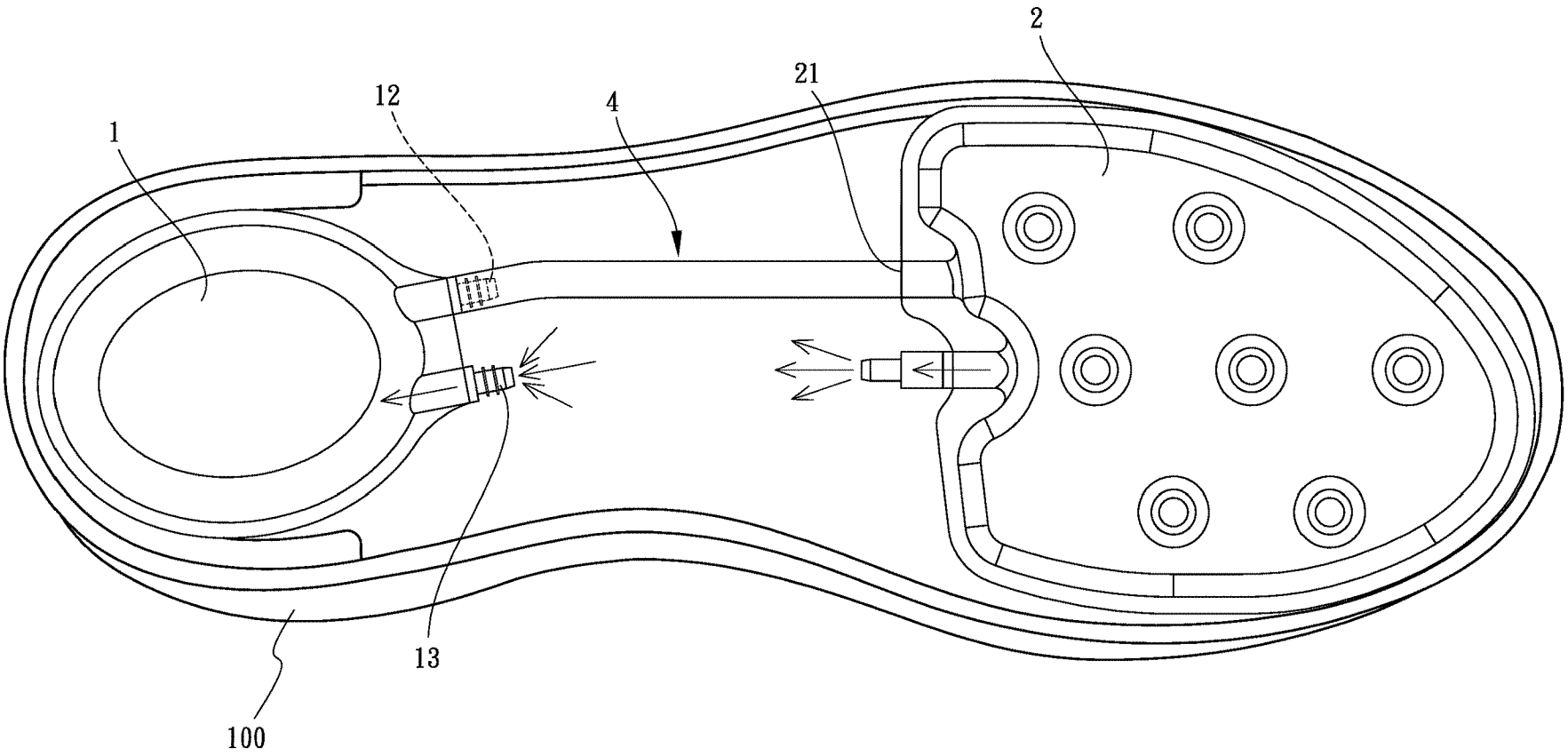
FIG. 7 shows the flow of the air in the situation disclosed in FIG. 6.
Figure 8:
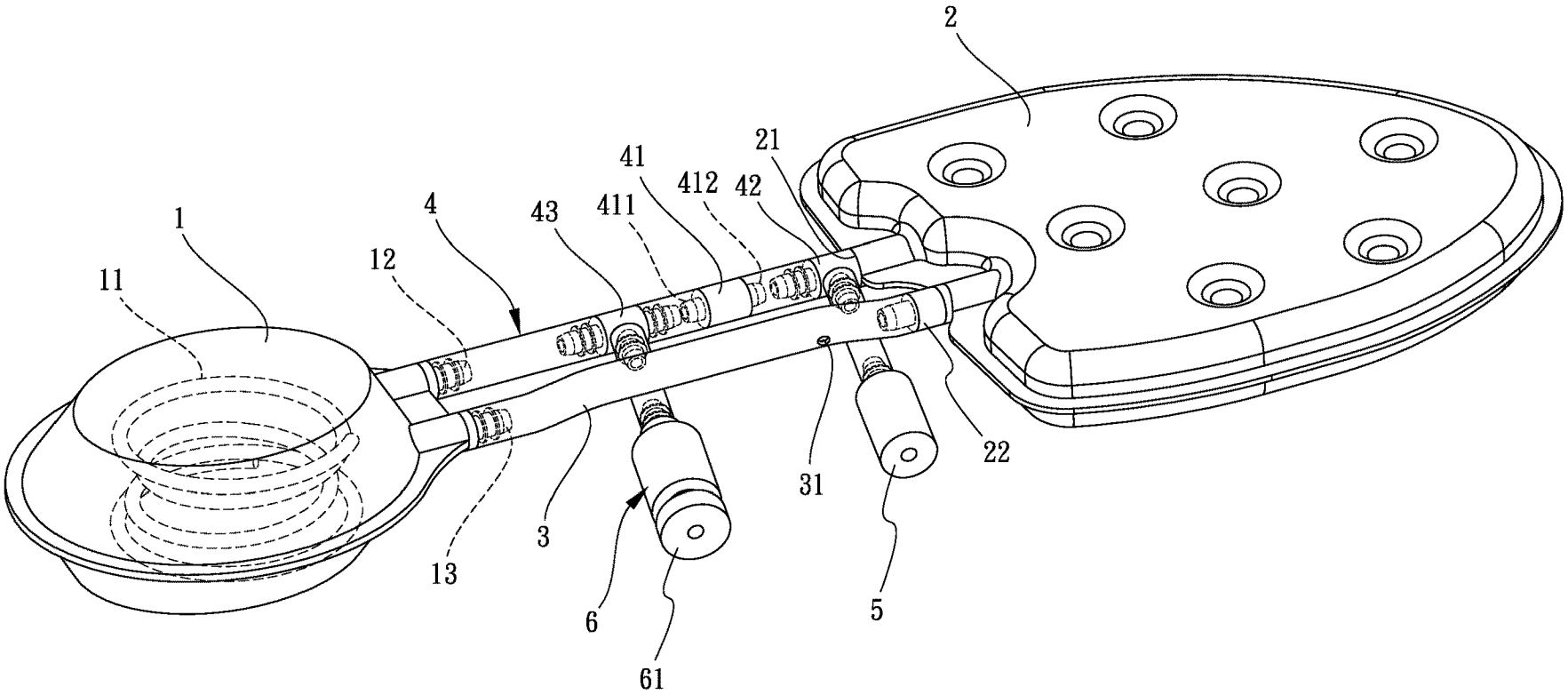
FIG. 8 shows that the first and second regulating valves of the air pad assembly of the present invention.
Figure 9:
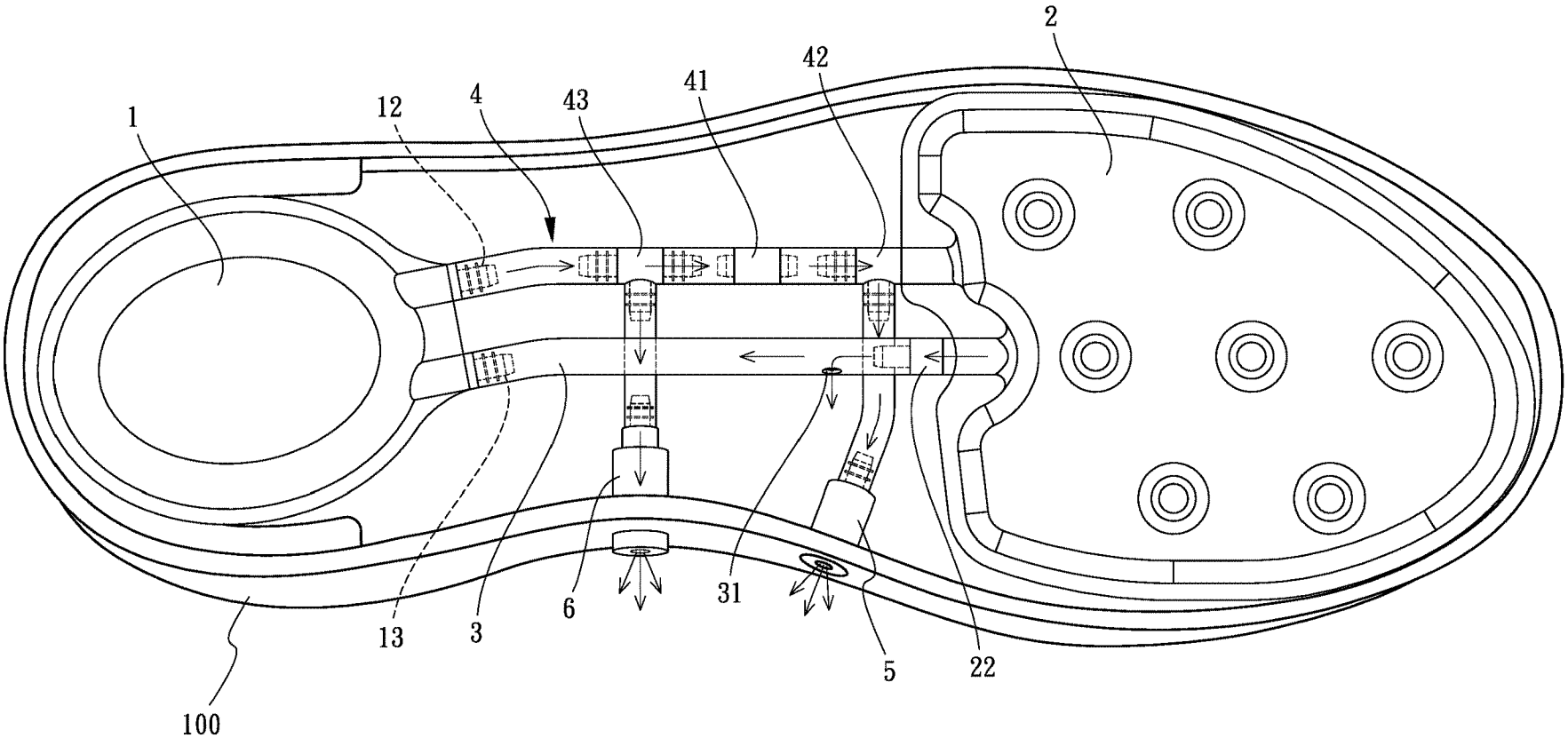
FIG. 9 shows the flow of the air in the pad assembly of the present invention with the first and second regulating valves, when the rear air pad is compressed.
Figure 10:
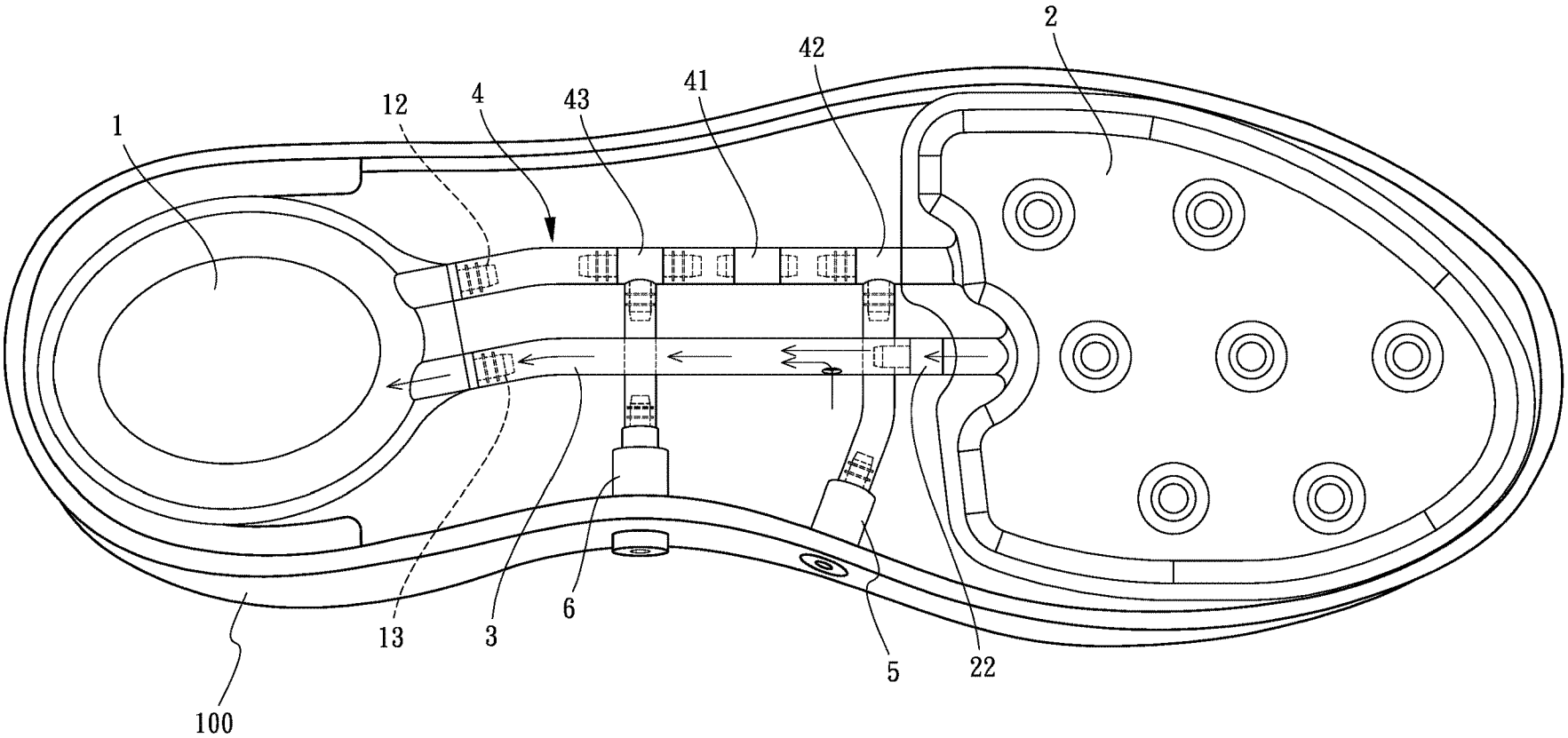
FIG. 10 shows the flow of the air in the air pad assembly of the present invention with the first and second regulating valves, when the rear air pad is released and the front air pad is compressed.

As shown in FIG. 8, a second tube 3 is connected between a release end 222 of the release valve 22 and an inlet end of the second one-way valve 13. A hole 31 is defined through the wall of the second tube 3. As shown in FIGS. 4 and 9, when the rear air pad 1 is compressed, one of two portions of the air released from the release valve 22 is released from the hole 3 via the hole 31, and another one of the two portions of the air released from the release valve 22 flows to the second one-way valve 13. As shown in FIGS. 6 and 10, when the wearer's heel lifts and the rear air pad 1 bounces back, the air sucked by the rear air pad 1 flows into the second tube 3 via the release valve 22 and the hole 31 of the second tube 3. The first and second tubes 4, 3 extend in a common direction so that the front and rear air pads 1, 2 do not twist.

As shown in FIGS. 4 and 9, a third one-way valve 41 and a first connector 42 are received in the first tube 4. The third one-way valve 41 is connected between the first one-way valve 12 and the inlet 21 of the front air pad 2. The third one-way valve 41 includes a first port 411 and a second port 412. The air irreversibly flows from the first port 411 to the second end 312. The first connector 42 includes a first end, a second end and a third end, wherein the first end of the first connector 42 is connected to the inlet 21, the second end of the first connector 42 is connected to the second port 412 of the third one-way valve 41, and the third end of the first connector 42 is connected to a first regulating valve 5 exteriorly connected to the first tube 4. When the air in the front air pad is saturated, the air flowing toward the inlet 21 is released from the regulating first valve 5. When the rear air pad 1 is frequently compressed, the front air pad 22 is ensured not to be overly inflated by the use of the release valve 22.

Furthermore, the first tube 4 includes a second connector 43 received therein. The second connector 43 includes a first end, a second end and a third end. The first end of the second connector 43 is connected to the first port 411 of the third one-way valve 41. The second end of the second connector 43 is connected to a second regulating valve 6 exteriorly connected to the first tube 4. The second regulating valve 6 regulates the air volume that flows from rear air pad 1 toward the third one-way valve 41.

As shown in FIG. 8, the second regulating valve 6 includes a knob 61, and the knob 61 controls the air pressure of the air flow that flows from the rear air pad 1 toward the front air pad 2. Because different wearers have different weights so that the force and frequency that the wearer's heel compresses the rear air pad 1 are different, the wearer can operate knob 61 to control the volume of air and to control the air pressure of the air from the rear air pad 1 to the front air pad 2.

Figure 3:
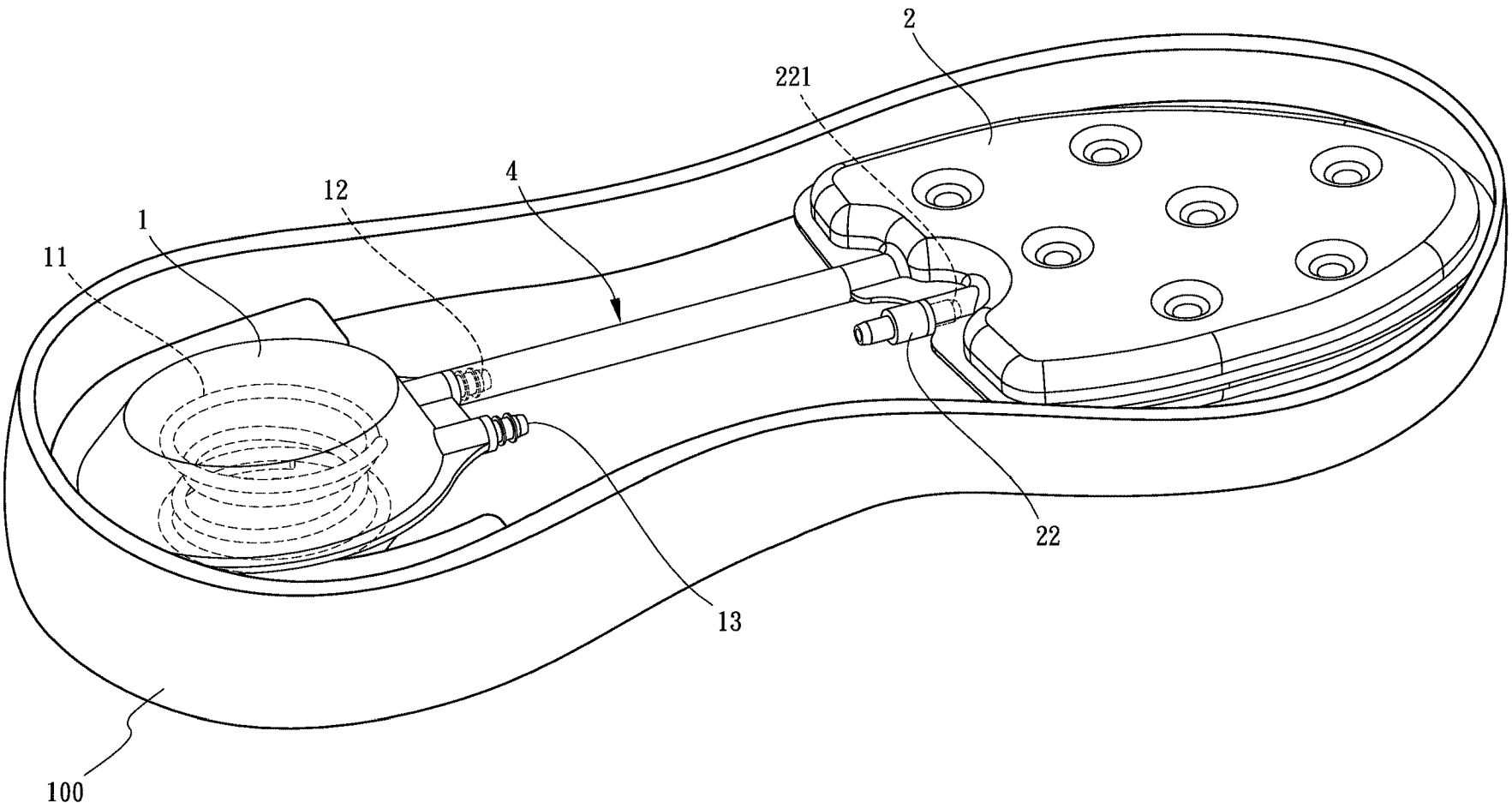
FIG. 3 shows the bottom view of the air pad assembly of the present invention installed in a shoe.
Figure 11:
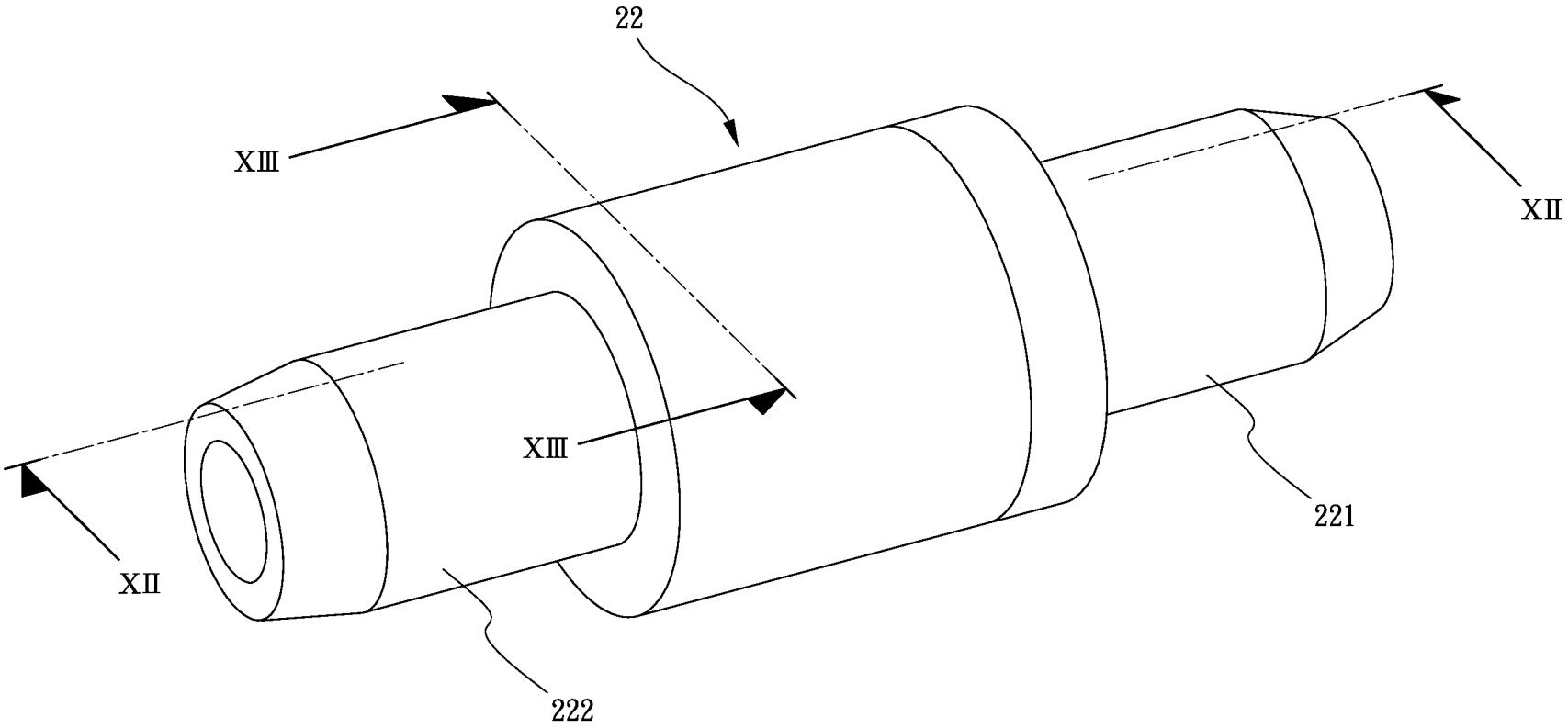
FIG. 11 shows the release valve of the air pad assembly of the present invention.
Figure 12:
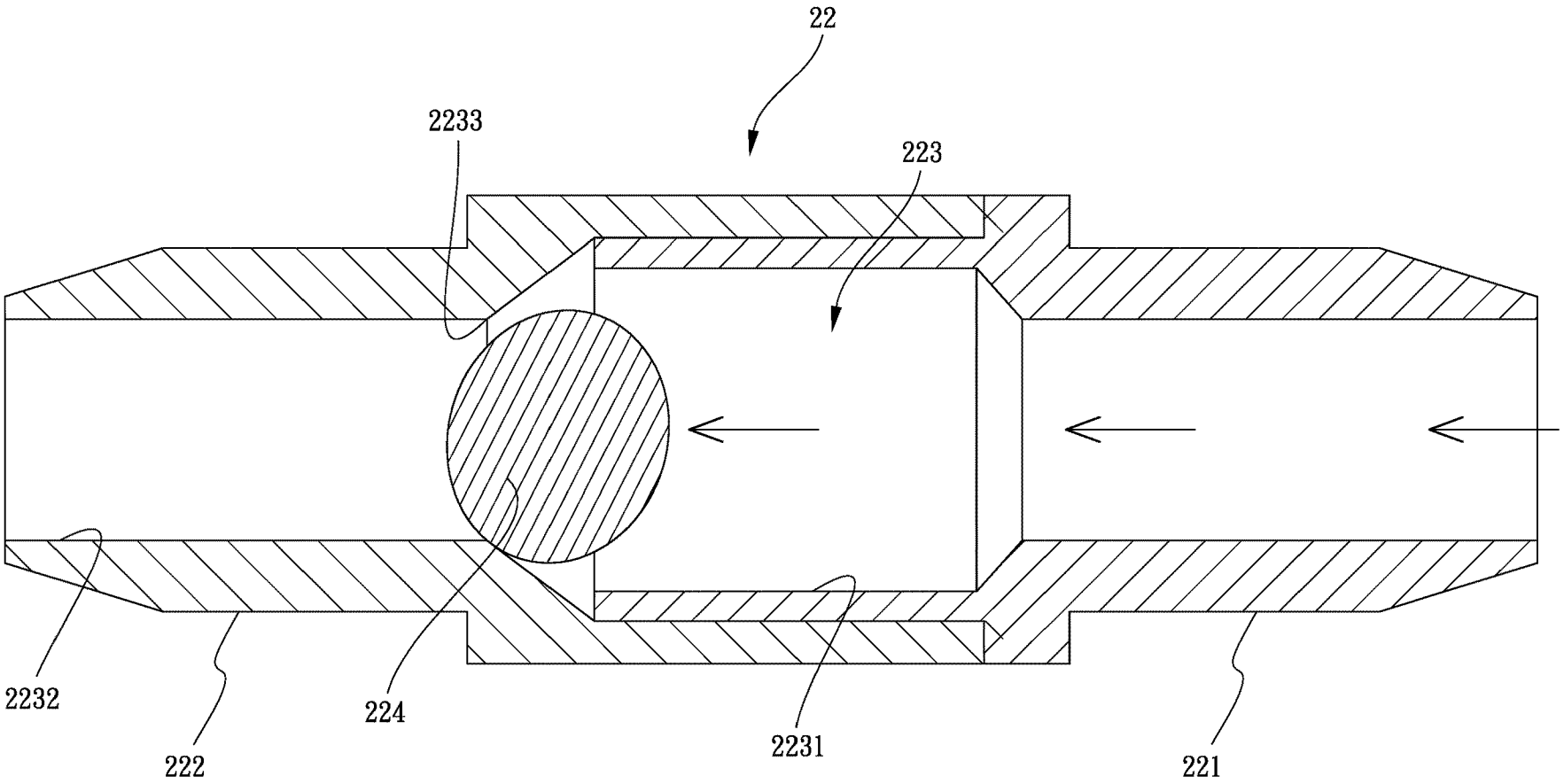
FIG. 12 is a cross sectional view, taken along line XII-XII in FIG. 11.
Figure 13:
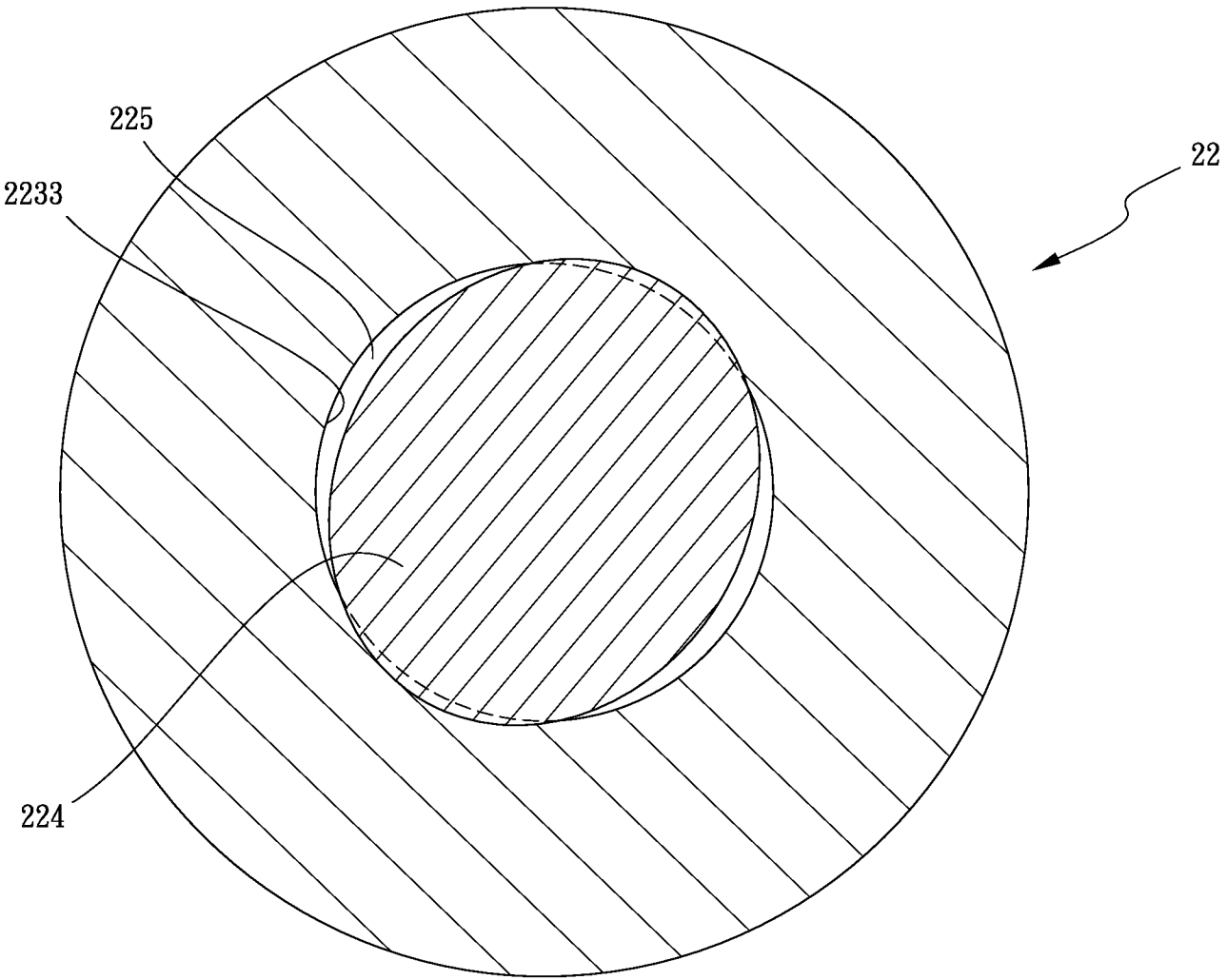
FIG. 13 is a cross sectional view, taken along line XIII-XIII in FIG. 12.

FIGS. 3, 11 and 13 show that the release valve 22 includes an entrance end 221 and a release end 222 respectively formed on two ends thereof. The entrance end 221 is connected to the front air pad 2. A chamber 223 is formed between the entrance end 221 and the release end 222. The chamber 223 is defined by the first chamber 2231 and the second chamber 2232 which is smaller than the first chamber 2231 so as to form an opening 2233 at a conjunction portion between the first chamber 2231 and the second chamber 2232. The second chamber 2232 communicates with the release end 222. An adjustment ball 224 is movably located in the first chamber 2231. When air enters into the first chamber 2231 from the entrance end 221, the adjustment ball 224 is pushed by the air to partially seal the opening 2233 so as to form a gap 225 between the adjustment ball 224 and the inner periphery of the opening 2233. The adjustment ball 224 is flexible and is deformed along with the pressure of the air applied to the adjustment ball 224. The size of the gap 225 is also adjusted by the levels of deformation of the adjustment ball 224. The smaller the gap 225 is, the less volume of air is released, such that the wearers can adjust the buffering feature according to practical needs.

While we have shown and described the embodiment in accordance with the present invention, it should be clear to those skilled in the art that further embodiments may be made without departing from the scope of the present invention.

What is claimed is:

1. An air pad assembly for shoes, comprising:

a rear air pad having a resilient member received therein, a first one-way valve and a second one-way valve respectively connected to the rear air pad, the rear air pad sucking exterior air from the second one-way valve;

a front air pad having a release valve and an inlet, a first tube connected between the inlet of the front air pad and the first one-way valve of the rear air pad, when the rear air pad is compressed, air in the rear air pad flows into the front air pad via the connected the first one-way valve, the first tube and the inlet, air in the front air pad releases from the release valve, wherein a maximum air volume released from the release valve is smaller than a maximum air volume entering into the inlet of the front air pad, and the release valve including an entrance end anti a release end respectively formed on two ends thereof, the entrance end connected to the front air pad, a chamber formed between the entrance end and the release end, the chamber defined by a first chamber and a second chamber which is smaller than the first chamber so as to form an opening at a conjunction portion between the first chamber and the second chamber, the second chamber communicating with the release end, an adjustment ball movably located in the first chamber, when air enters into the first chamber from the entrance end, the adjustment ball is pushed by the air to partially seal the opening so as to form a gap between the adjustment ball and an inner periphery of the opening.

2. The air pad assembly for shoes as claimed in claim 1, wherein a second tube is connected between a release end of the release valve and an inlet end of the second one-way valve, a hole is defined through a wall of the second tube, when the rear air pad is compressed, one of two portions of the air released from the release valve is released from the hole via the hole, another one of the two portions of the air released from the release valve flows to the second one-way valve, when the rear air pad bounces back, the air sucked by the rear air pad flows into the second tube via the release valve and the hole of the second tube.

3. The air pad assembly for shoes as claimed in claim 2, wherein the first and second tubes extend in a common direction so that the front and rear air pads do not twist.

4. The air pad assembly for shoes as claimed in claim 2, wherein a third one-way valve and a first connector are received in the first tube, the third one-way valve is connected between the first one-way valve and the inlet of the front air pad, the third one-way valve includes a first port and a second port, the air irreversibly flows from the first port to the second end, the first connector includes a first end, a second end and a third end, the first end of the first connector is connected to the inlet, the second end of the first connector is connected to the second port of the third one-way valve, the third end of the first connector is connected to a first regulating valve exteriorly connected to the first tube, when the air in the front air pad is saturated, the air flowing toward the inlet is released from the regulating first valve.

5. The air pad assembly for shoes as claimed in claim 4, wherein the first tube includes a second connector received therein, the second connector includes a first end, a second end and a third end, the first end of the second connector is connected to the first port of the third one-way valve, the second end of the second connector is connected to a second regulating valve exteriorly connected to the first tube, the second regulating valve regulates an air volume that flows from rear air pad toward the third one-way valve.

6. The air pad assembly for shoes as claimed in claim 5, wherein the second regulating valve includes a knob, the knob controls an air pressure of the air flow that flows from the rear air pad toward the front air pad.

* * * * *